United States Patent [19]

Taipale et al.

[11] Patent Number: 4,986,883

[45] Date of Patent: Jan. 22, 1991

[54] METHOD FOR CALENDERING PAPER AND PAPER MANUFACTURED BY THE METHOD

[75] Inventors: Jyrki Taipale, Tampere; Jaakko Sarantola, Valkeakoski, both of Finland

[73] Assignee: Yhtyneet Paperitehtaat Oy, Valkeakoski, Finland

[21] Appl. No.: 366,978

[22] Filed: Jun. 16, 1989

[30] Foreign Application Priority Data

Nov. 17, 1988 [FI] Finland ..... 885319

[51] Int. Cl.[5] ..... D21G 1/00

[52] U.S. Cl. ..... 162/205; 162/206; 100/93 RP; 100/163 A

[58] Field of Search ..... 162/205, 206, 252, DIG. 10, 162/187; 100/38, 93 RP, 163 A

[56] References Cited

U.S. PATENT DOCUMENTS 3,268,354 8/1966 Hain .

4,012,543 3/1977 Ranger et al. .

4,257,843 3/1981 Watanabe et al. ..... 162/146

*Primary Examiner*—David A. Simmons

*Assistant Examiner*—Thi Dang

*Attorney, Agent, or Firm*—Pollock, Vande Sande & Priddy

[57] ABSTRACT

A method for calendering paper, especially with glassine calendering in a calender which comprises press rolls arranged successively in the paper-advancing direction where, at least between some of the rolls, press nips are formed for passing paper therethrough. Each press nip is preferably formed by a pair of rolls, one of which is hard and the other elastic. Paper is advanced into the calender at an initial moisture X within the range of $12\% \leqq X \leqq 25\%$, at least one of the press nips having a calculable line pressure higher than 250 kN/m. In operating conditions, the ratio X/LP between paper moisture X and calculable line pressure LP is maintained in the press nips within predetermined limits in such a manner that the maximum value of ratio X/LP divided by the minimum value of ratio X/LP is $\leqq 2.15$, whereby X refers to the moisture percentage of paper and LP is the line pressure at a particular press nip expressed as a quantity kN/m (kilonewton/meter).

9 Claims, No Drawings

METHOD FOR CALENDERING PAPER AND PAPER MANUFACTURED BY THE METHOD

BACKGROUND OF THE INVENTION

The present invention relates to a method for calendering paper, particularly with so-called glassine calendering, in the calender comprising press rolls arranged one after the other in the paper running direction. Between at least some of the rolls there will be pressing nips for passing paper therethrough. Preferably, each nip is formed by a pair of rolls, one being hard and the other elastic. Paper is advanced into the calender at an initial moisture X, which is within the range of $12\% \leqq X \leqq 25\%$. At least one of the nips is given a calculated line pressure which exceeds 250 kN/m.

Glassine calendering is a special application of traditional supercalendering. Paper is generally advanced into the calender at a relatively high initial moisture and the line pressures applied are substantially higher than in traditional calendering. The number of rolls and hence the total number of nips in a glassine calender exceeds that used in traditional supercalendering since, at least in some applications, such calender acts as "a drying machine" at the same time. The final moisture of the paper is typically about 6%.

In other respects the principle of glassine calendering is similar to traditional supercalendering. This means that every second roll is soft, for example a paper roll (hardness less than 95° Shore D) and every second roll is an internally heated metal roll.

However, the demands set on a final product are clearly different in glassine calendering from those in supercalendering. The objective in glassine calendering is to provide a paper having a uniform thickness, high transparency and high density and having a high hold-out capacity for surface solvents.

Generally in prior known supercalenders, especially in those that are constructed from vertically superimposed rolls, the lead-in of paper into a calender or the unwinding of a roll of paper is positioned in the top section of a supercalender and a paper web is always brought out of the supercalender at the bottom section where the rewinding takes place. Thus, the paper web travels from a top nip to a bottom nip. This running mode does not produce the best possible results especially in glassine calendering since the highest line pressures are not applied to paper until the paper has almost reached its final moisture, at which time the resistance to shaping in the paper is at its peak.

SUMMARY OF THE INVENTION

The present method aims to put the potential of glassine calendering to better use in developing the characteristics of a final product. In order to achieve this object, a method of the present invention is mainly characterized in that, in the operating conditions, the ratio X/LP between paper moisture X and calculable line pressure LP in the nips is maintained within a predetermined range in such a manner that (X/LP)max: (X/LP)min is lower than or equal to 2.15. Thus, X refers to the moisture percentage of paper (moisture, moisture percentage or final moisture percentage refers in this context to the relative share of water of the total paper pulp.) LP is a line pressure in a given nip as expressed in the quantity kN/m (kilonewton/meter), (X/LP)max is the ratio at its highest and (X/LP)min is the ratio at its lowest in a particular operating situation.

DETAILED DESCRIPTION OF THE PREFERRED EMBODIMENT

The method allows for the production of papers having characteristics clearly superior to those obtained on the same base paper by traditional calendering techniques.

It is obvious that the method of the invention can be utilized with various outset values, for example, in such a manner that the initial moisture of a paper web is reduced to X about 12% for increasing the output of a calender used in the method as a result of a lesser drying demand. A paper produced with a method of the invention is technically ready for use, with the exception of moisture, as quickly as after a few press nips which is why the desired result can be achieved with a number of press nips fewer than in traditional glassine calendering. The method can be utilized by reducing the line pressure in press nips as compared to traditional methods whenever the object is to produce a glassine type of release paper grade of conventional quality. An advantage gained this way is that the paper rolls have a longer service life or a longer time span between grinding and resurfacing operations, resulting in cost savings.

The gist of a method of the invention can be summarized as follows; By the application of the method of the invention it is possible to produce a special paper, particularly the so-called release paper, by means of equipment involving substantially less investment costs than the present-day equipment, the capacity of available production machinery can be increased and costs per unit can be decreased. The above features make it possible to mount an apparatus for the application of a method of the invention in connection with a papermaking machine as one of its operating units.

A paper manufactured with the method of the invention has a combination of characteristics which is definitely novel over the prior known special grade papers, particularly so-called release paper.

The following table 1 illustrates by way of an example and in a tabulated fashion the values of the moisture and calculable line pressure in a calender consisting of sixteen nips. The numbering of nips increases in the web advancing direction.

TABLE 1

| Nip No. (running order) | Paper moisture (%) | Calculable line pressure LP (kN/m) | Ratio moisture/ line pressure ($\times 10^{-2}$) | Ratio X/LP max/min |
|---|---|---|---|---|
| 1 | 19.5 | 450 | 4.3 | 4.3/2.1 = 2.05 |
| 2 | 15.3 | 439 | 3.5 | (i.e. lower |
| 3 | 13.4 | 425 | 3.2 | than 2.15) |
| 4 | 11.5 | 414 | 2.8 | |
| 5 | 10.4 | 402 | 2.6 | |
| 6 | 9.3 | 391 | 2.4 | |
| 7 | 8.7 | 380 | 2.3 | |
| 8 | 7.9 | 369 | 2.1 | |

TABLE 1-continued

| Nip No. (running order) | Paper moisture (%) | Calculable line pressure LP (kN/m) | Ratio moisture/ line pressure ($\times 10^{-2}$) | Ratio X/LP max/min |
|---|---|---|---|---|
| 9 | 7.7 | 359 | 2.1 | |
| 10 | 7.3 | 348 | 2.1 | |
| 11 | 7.1 | 337 | 2.1 | |
| 12 | 6.9 | 326 | 2.1 | |
| 13 | 6.6 | 316 | 2.1 | |
| 14 | 6.3 | 305 | 2.1 | |
| 15 | 6.2 | 293 | 2.1 | |
| 16 | 6.0 | 280 | 2.1 | |

As indicated in the table, the ratio of moisture/line pressure (X/LP) in the first nip is at its maximum and has a reading $4.3\times10^{-2}$. After the eighth nip, the ratio of moisture/line pressure (X/LP) became nearly constant and was of the order of $2.1\times10^{-2}$. The ratio X/LP remains within certain limits in a manner that the highest ratio divided with the lowest gives a reading which is lower than or equal to 2.15.

After a certain minimum number (in practice 6–8 nips), it was also found that the nip number had no effect other than on final moisture and, to some degree, on caliber.

The following table 2 shows a comparison of characteristics, the comparative products being the same base paper calendered with a traditional method described in the beginning of this specification and with the method of the present invention.

TABLE 2

| Characteristics of paper | Traditional method | Method of the invention |
|---|---|---|
| IGT stain length (cm) | 13.5 ± 0.5 | >14 |
| Elrepho transparancy (%) | | |
| 100% bleached pulp | 50 ± 2 | >55 |
| partly ½ bleached pulp | 47 ± 2 | >52 |
| Unger oil absorption ($g/(m^2 \times 1$ min)) | 0.9 ± 0.2 | 0.5 |
| thickness (um) | 57 ± 2 | 58 ± 3 |
| grammage ($g/m^2$) (at circa 6% moisture) | 65 ± 1 | 65 ± 1 |

It can be concluded from table 2 that each of the characteristics required of a special grade paper, especially release paper, would not deteriorate, and the combined effect of characteristics produces a highly favorable end result. These are the characteristics of a highly dense paper for a relatively bulky paper.

The paper grade used in a method of the present invention is manufactured from a chemical, semi-bleached and/or bleached softwood and/or hardwood pulp. It is surface-sized, preferably with a polyvinyl alcohol (PVA) or a carboxy-methyl cellulose (CMC) material or a mixture thereof. The paper making has been effected by using conventional chemicals and additives for improving certain properties.

After the application of the method, paper moisture is within the range of $3\% \leqq X \leqq 8\%$.

Transparency (Elrepho Transparency) is determined with the method: SFS 3517.

IGT-value (IGT stain length) is determined with the method: Al-pendulum device for IGT.

Unger-value (Unger oil absorption) is determined with the method: SCAN-P:37.

We claim:

1. A method for calendering paper in a calender including press rolls arranged successively in a paper advancing direction with press nips being formed between at least some of the rolls for passing paper therethrough, each press nip being formed by a pair of rolls, one being hard and the other elastic, and having a calculable line pressure, said method comprising the steps of:

advancing the paper into said calender at an initial paper moisture X being within the range of $12\% \leqq X \leqq 25\%$ and the calculable line pressure of at least one of the nips being higher than 250 kN/m; and maintaining a ratio X/LP during operation between a paper moisture X and a calculable line pressure LP of a nip within predetermined limits in such a manner that a maximum value of ratio X/LP as divided by a minimum value of ratio X/LP is lower than or equal to 2.15, wherein said X refers to the a moisture percentage of paper and LP is a line pressure in a particular press nip expressed as a quantity kN/m (kilonewton/meter).

2. A method according to claim 1, wherein the ratio X/LP is being decreased at least in a first few press nips of said calender in a such manner that the ratio X/LP at a nip upstream in the paper advancing direction is higher than at a next press nip downstream of said upstream press nip.

3. A method according to claim 2, wherein the ratio X/LP decreases from a first nip up to about halfway through the calender.

4. A method according to claim 3, wherein the ratio X/LP is maintained substantially constant over a downstream half of the calender.

5. A method according to claim 2, wherein towards a final stage of the calendering operation, over the downstream halfway through calendering, the ratio X/LP is maintained substantially constant.

6. A method according to claim 1, wherein towards a final stage of the calendering operation the ratio X/LP is maintained substantially constant.

7. A method according to claim 1, wherein the ratio X/LP has a minimum value which is about 2.1.

8. A method according to claim 1, wherein the ratio X/LP has a maximum value which is of no more than about 4.3.

9. A method according to claim 1, wherein a final paper moisture X is selected within the range of $3\% \leqq X \leqq 8\%$.

* * * * *